US006595878B1

(12) United States Patent
Nelson

(10) Patent No.: US 6,595,878 B1
(45) Date of Patent: Jul. 22, 2003

(54) FLAT GOAL TARGET

(76) Inventor: Timothy Nelson, P.O. Box 66, Camillus, NY (US) 13031

( * ) Notice: Subject to any disclaimer, the term of this patent is extended or adjusted under 35 U.S.C. 154(b) by 0 days.

(21) Appl. No.: 09/384,546

(22) Filed: Aug. 27, 1999

(51) Int. Cl.[7] ..... A63B 69/40
(52) U.S. Cl. ..... 473/476; 273/407
(58) Field of Search ..... 273/358, 407, 273/409; 473/476

(56) References Cited

U.S. PATENT DOCUMENTS

| | | | | |
|---|---|---|---|---|
| 812,589 | A | | 2/1906 | McNelly |
| 1,223,290 | A | * | 4/1917 | Ravenshear |
| 1,381,466 | A | | 6/1921 | Jackson, Jr. |
| 1,511,430 | A | | 10/1924 | Schonberg |
| 3,856,298 | A | | 12/1974 | Frantti |
| 4,344,621 | A | * | 8/1982 | Baker |
| 4,629,188 | A | * | 12/1986 | Mahieu |
| D321,370 | S | | 11/1991 | Curtis |
| 5,509,650 | A | | 4/1996 | MacDonald |
| 5,549,302 | A | | 8/1996 | Lapsker et al. |

* cited by examiner

*Primary Examiner*—William M. Pierce
(74) *Attorney, Agent, or Firm*—Bernhard P. Molldrem, Jr.

(57) ABSTRACT

A flat goal target can be attached to an available outside (brick) wall, i.e., at a school building. The goal target is a flat fabric, woven or non-woven, i.e., a sturdy vinyl. The image of a goal and goalkeeper is printed on the fabric. Attaching strips, which can be made of stiff or male Velcro material, may be adhesively secured to the brick wall. The adhesive is strong enough to keep the target up, but giving enough not to harm the wall. The target can be set up for practice, and taken down between practice times. This permits the lacrosse player, hockey player, or other athlete to practice by hitting the ball against the wall, with an objective that simulates game conditions. In a variation, thin flat aluminum sheets are positioned behind the goal target in the goal areas not covered by the goalie figure. These act as a sounder to let the player know he or she is on target. As an alternative, the same system can be used to simulate a tennis net. There may be other attachment provided, e.g., metal fasteners or clips.

3 Claims, 5 Drawing Sheets

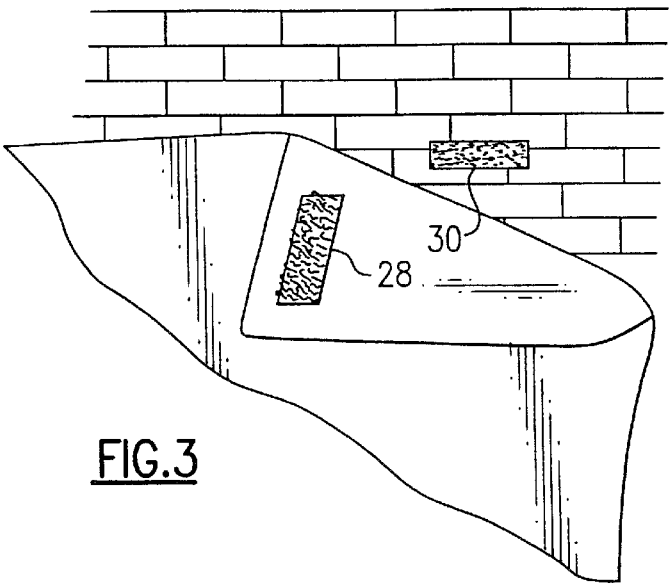
FIG.3
FIG.4
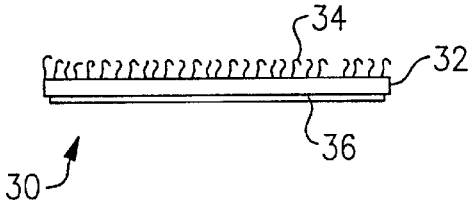
FIG.5
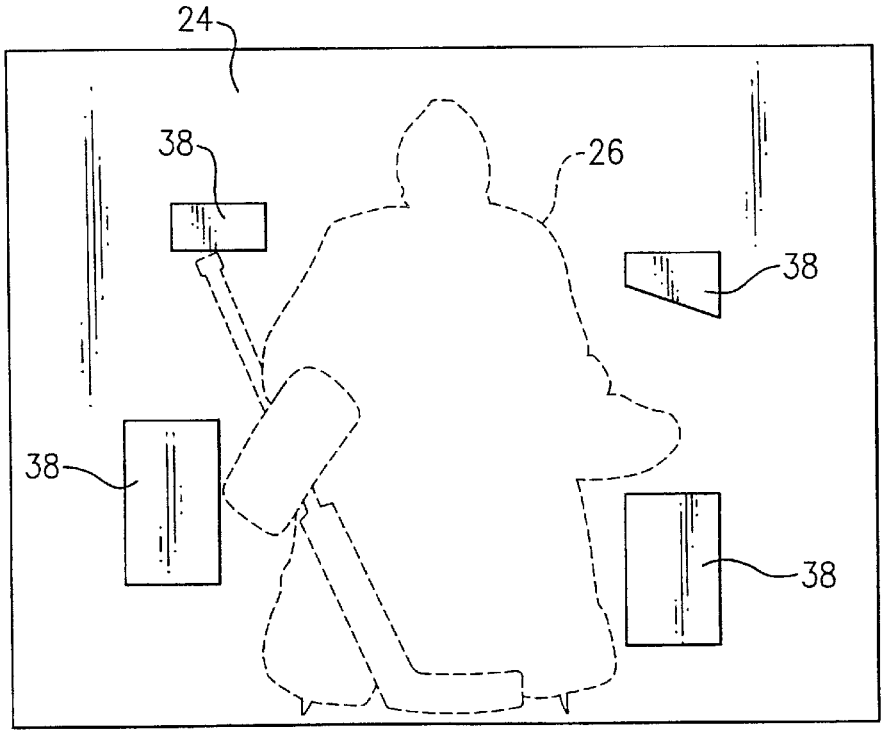

FLAT GOAL TARGET

BACKGROUND OF THE INVENTION

This invention is directed to sports practice targets, and is especially directed to flat goal targets that can be detachably mounted on an outside wall and used in practice to throw or hit a ball against it.

It is common to use an exterior wall of a building for practice drills in throwing or hitting a ball against the wall. For example, tennis players often hit tennis balls against a wall to work on their stroke and volley, and in other sports, such as lacrosse or hockey, the players can throw the ball (or other projectile) against a wall from their stick. In each case, the wall provides a hard vertical surface, provided that there is an expanse that is free of doors and windows. The building wall can typically be made of brick, stone, or concrete. The ball thrown or hit against the hard surface rebounds strongly off the wall, and lets the players practice on their volley (e.g., in tennis) or practice receiving the ball after a rebound (e.g., in roller hockey or lacrosse). Most schools have at least one wall of a building near the athletic facilities that is or can be used for target drills or for similar practice, either in groups or individually.

However, no suitable targets have been available that can be used in connection with the brick, stone, or concrete walls in this fashion, and which do not require special hardware that has to be permanently affixed onto the wall. There are a number of goal targets that are attached directly onto the face of a hockey or lacrosse goal, or onto a special frame, but these cannot be easily adapted to attach onto a flat, rigid wall. Other targets have been proposed that are made of an inert, energy-absorptive material, which does not permit the ball or projectile to rebound from the target in any realistic fashion.

OBJECTS AND SUMMARY OF THE INVENTION

Accordingly, it is an object of this invention to provide a target that permits a lacrosse player, hockey player, or other athlete to practice by throwing or hitting a ball (or like projectile) against, and which avoids the drawbacks of the prior art.

It is another object to provide a target that can be quickly set up on a wall and quickly taken down from the wall, and which does not damage the wall.

According to an aspect of the invention, a flat target that can be attached to an available outside (brick) wall, i.e., at a school building. The goal target or other sports target comprises a flat panel of fabric, which can be woven or non-woven, i.e., a sturdy reinforced vinyl. This can be relatively thin, e.g., 30 mils or less. The image of a goal and goalkeeper may be printed on the fabric. There are attaching means, e.g., a hook-and-loop fastener system, such as Velcro. One part of this is affixed to the wall, and that part may be made of the stiff or male strip of a Velcro material, with an adhesive backing that attaches the strip to the brick wall. This cement is strong enough to keep the target up, but giving enough not to harm the wall. These strips are inexpensive enough that they can be replaced if they come off. The other, or female part of the Velcro, is sewn or cemented at corresponding locations on the fabric target. The target can be set up for practice, and taken down between practice times. This permits the lacrosse player, hockey player, or other athlete to practice by hitting the ball against the wall, with an objective that simulates game conditions. In a variation, a thin flat aluminum sheet is positioned behind the sheet in the goal areas (i.e., the parts not covered by the goalie figure), and this acts as a sounder to let the player know he is hitting the target. As an alternative, the same system can be used to simulate a tennis net. There may be other attaching means provided e.g., metal fasteners or clips, that would attach to non-damaging members cemented to the brick stone or concrete wall.

The above and many other objects, features, and advantages of this invention will become apparent from the ensuing detailed description of a preferred embodiment, which is illustrated in the Accompanying Drawing.

BRIEF DESCRIPTION OF THE DRAWING

FIG. 3 illustrates a corner portion of a target, showing the attaching strips.

FIG. 4 is a top plan view of an attaching strip.

FIG. 5 is a view showing placement of metal sounder plates.

DETAILED DESCRIPTION OF A PREFERRED EMBODIMENT

Figure 1:
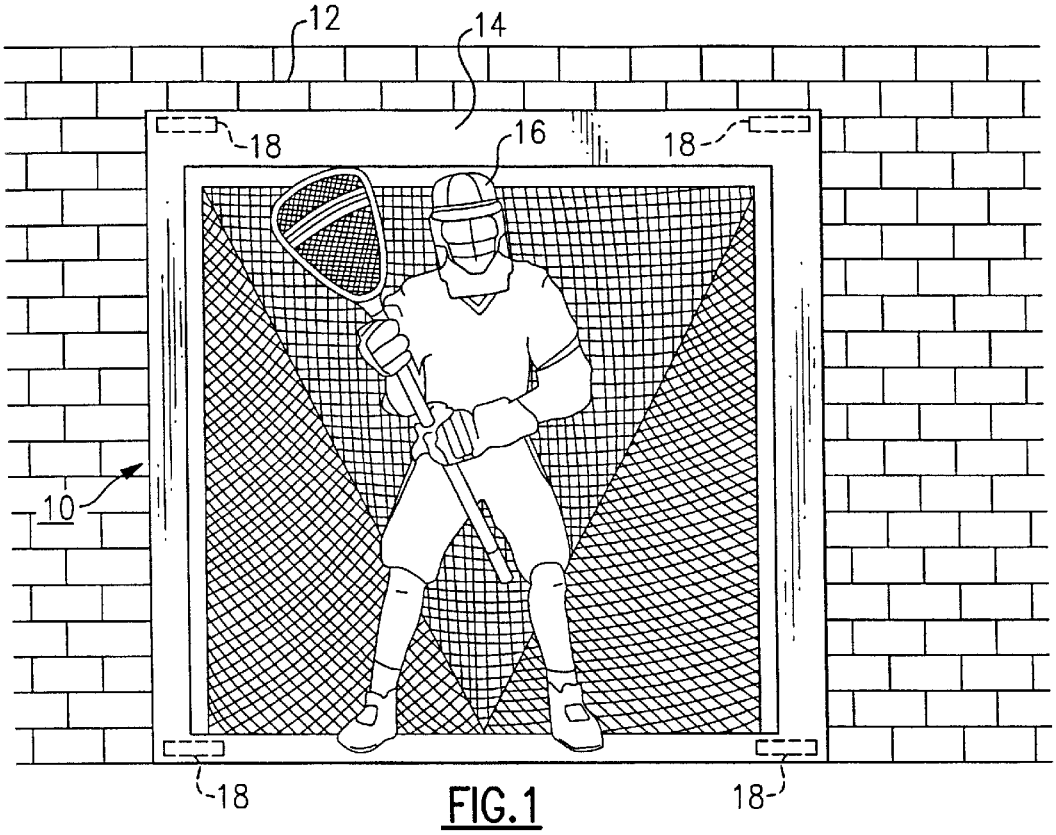
FIG. 1 is a front elevation of a lacrosse goal target according to one preferred embodiment of the present invention.

Now with reference to the Drawing, FIG. I illustrates a lacrosse target 10 that is set up against a brick outside wall 12. The target is made of a panel 14 of thin fabric, e.g., reinforced vinyl, which is durable and lightweight. This material also permits the energy of the ball thrown or hit at it to transmit through to the wall, and not be absorbed in the target 10, so that the ball can rebound realistically. Here, the target panel 14 is imprinted with a goal image 16, in this case a lacrosse goal with a goalie standing in the goal crease. As shown across the top of the panel, there are a number of strips 18 of a hook-and-eye fastener material, e.g., Velcro, that hold the goal target up onto corresponding strips that are attached onto the wall 12.

Figure 2:
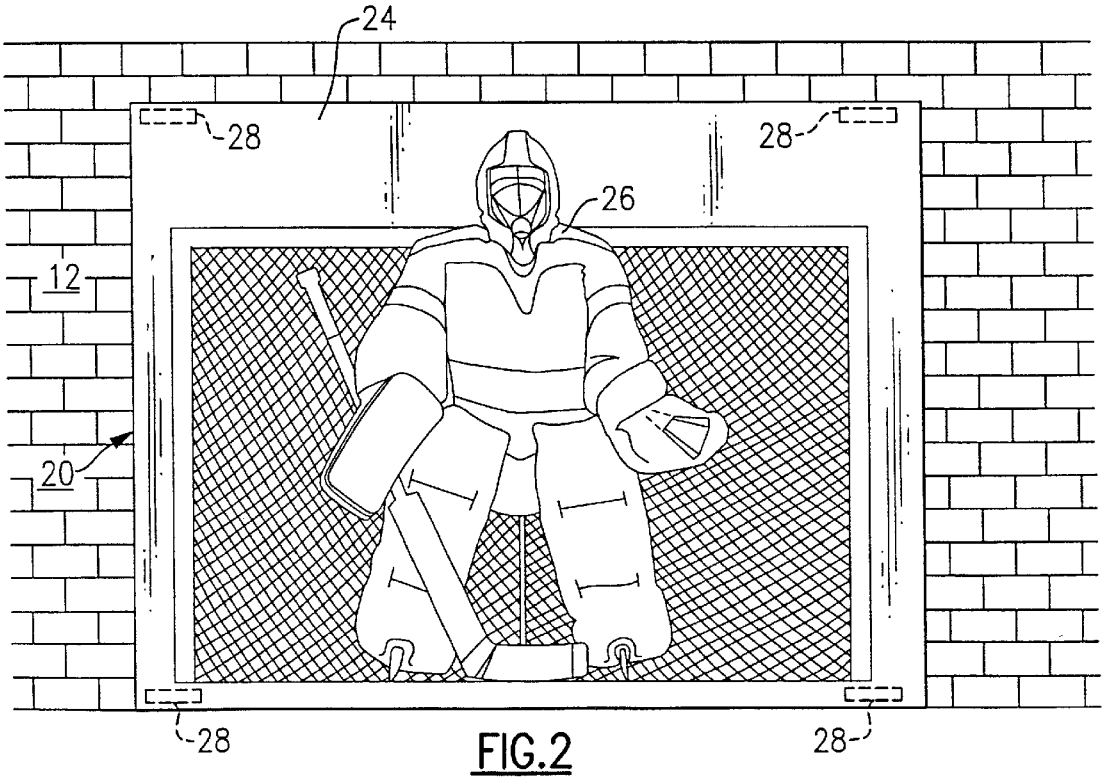
FIG. 2 is a front elevation of a roller hockey goal target according to another preferred embodiment of this invention.

Another goal target 20 of this invention is shown in FIG. 2, here a roller hockey goal target, which is likewise attached against the vertical brick outside wall 12. This goal target is in the form of a panel 24 of a durable, thin fabric material, such as reinforced vinyl, and carries an imprinted image 26 of a hockey goal and goalie. Like the previous embodiment, there are strips 28 of hook-and-eye attaching material sewn or otherwise attached to the reverse side near the top edge of the panel 24.

FIG. 3 shows one corner of the panel 24 pulled from the wall 12 and turned downward to reveal one of the strips 28, and to show a mating strip 30 of the male hook-and-eye material, which here is attached to the brick wall 12. The targets 10, 20 are provided with an ample supply of these strips 30 so that the targets can be repositioned and relocated, as desired, and also so that the strips 30 can be replaced if their cement fails and they come loose from the wall 12. As shown in FIG. 4, the male strip 30 has a base fabric portion 32, with hooks 34 on the side facing the target, and a cement or adhesive backing 36 on the side facing the wall. This can be a suitable contact adhesive which will hold the target in place in normal use, but will not damage the bricks of the wall 12 if it pulls away.

As mentioned previously, the targets 10 and 20 may optionally be provided with metal sheets or plates behind the fabric panels 14 and 24, at portions that correspond to the exposed goal or net not occupied by the goal tender. For example, as shown in FIG. 5, sheet metal pieces 38 can be positioned on the back side of the panel 24 of the hockey target 20 at positions indicated in the outline of the goal image 26. The metal pieces 38 make a distinctive clang or clatter when struck by the ball, giving the player audible feedback when his or her shots are on target.

Figure 6:
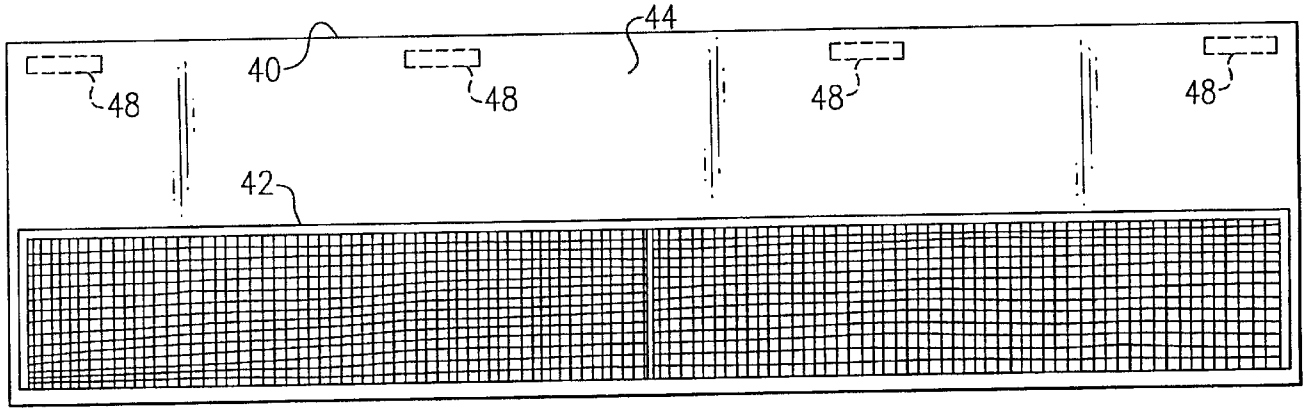
FIG. 6 is a front elevation of a tennis net target according to an embodiment or the invention.

FIG. 6 illustrates a tennis-net target 40, in which a tennis net image 42 is imprinted onto a fabric panel 44. As in the previous embodiments, there are hook-and-eye strips 48 sewn onto the back side of the panel 44 at or near the top edge. In this case, a deadening material may be provided behind the image of the net, i.e., below the net cord, to provide some additional realism. Also, other available materials, woven or non-woven, may be employed for the panels 14, 24, 44, etc.

Figure 8:
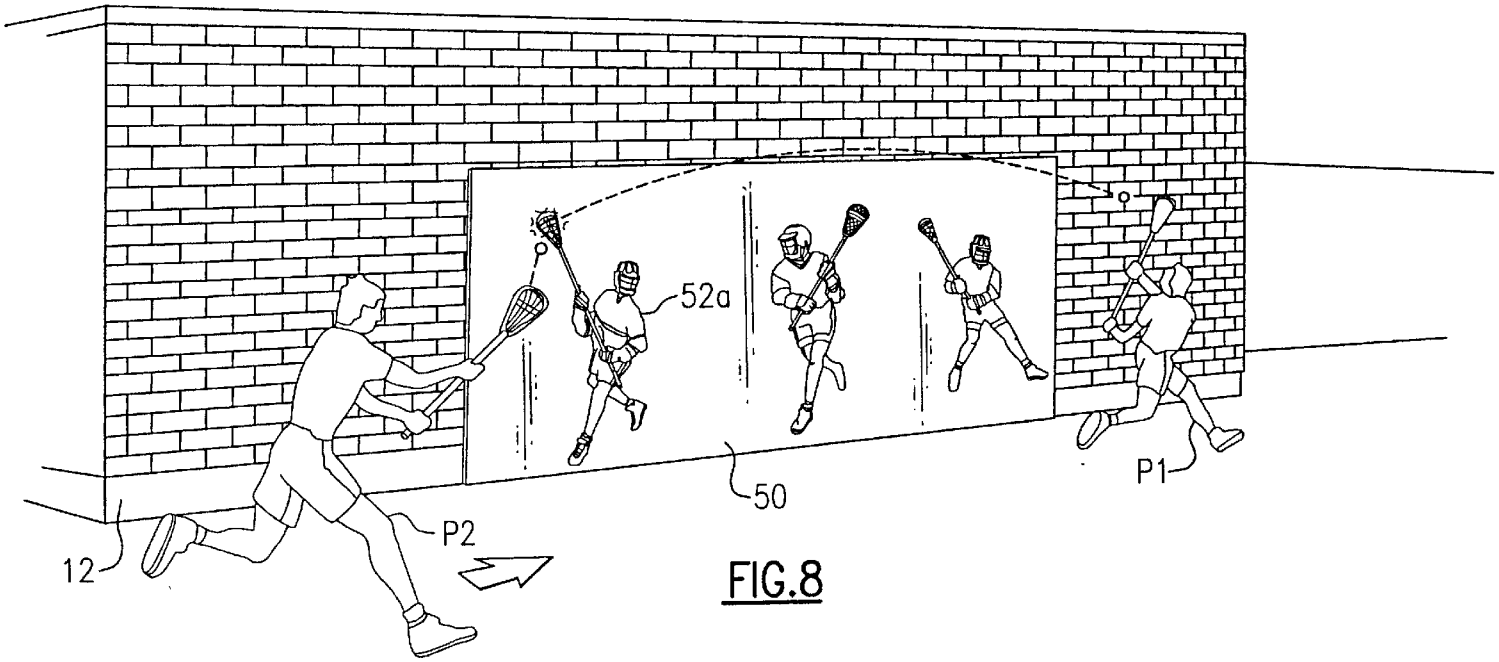
FIG. 8 is a perspective view illustrating a lacrosse practice or training drill employing the target of FIG. 7.
Figure 7:
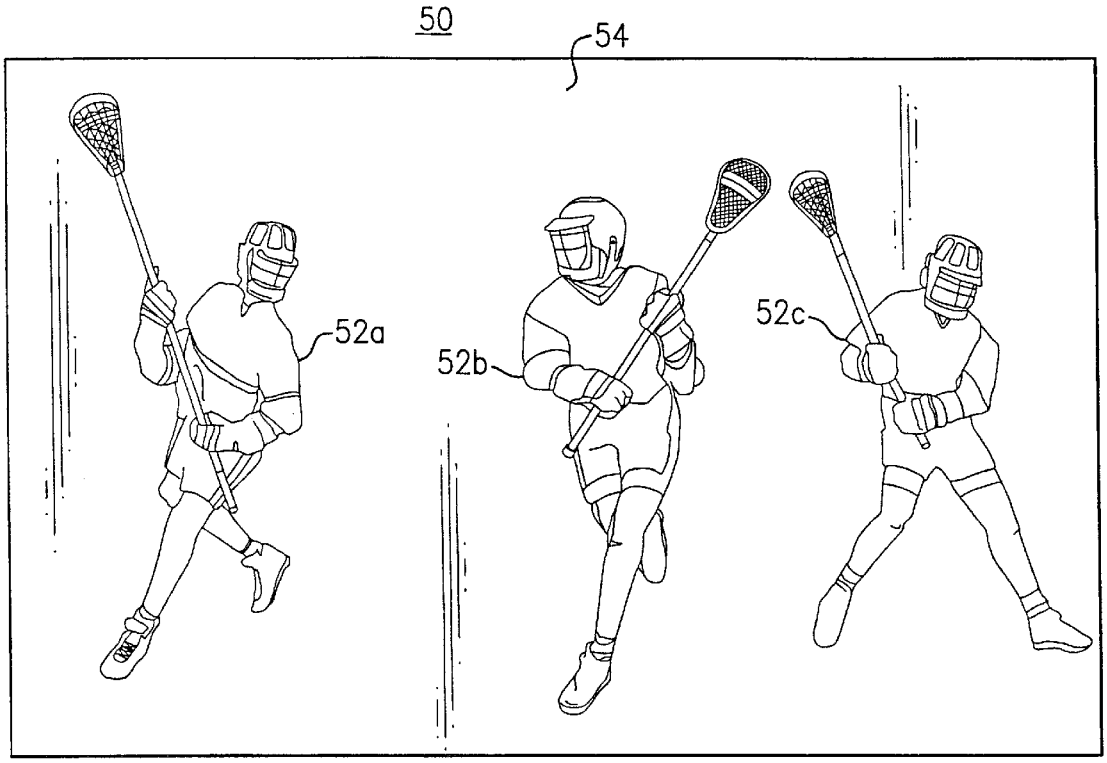
FIG. 7 is a front elevation of another lacrosse target according to an embodiment of this invention.

Another lacrosse target 50 is shown in FIG. 7. Here with three lacrosse player images 52*a*, 52*b*, and 52*c* imprinted on the front of a panel 54. This is suspended from an outside wall 12, as shown in FIG. 8. This view illustrates a lacrosse drill that may be practice in which a first player P1 throws a lacrosse ball from his lacrosse stick onto the target image 52*a*, and then another player P2 catches the rebound in his lacrosse stick. Many other catch-and-throw drills can be carried out using this system.

Figure 9:
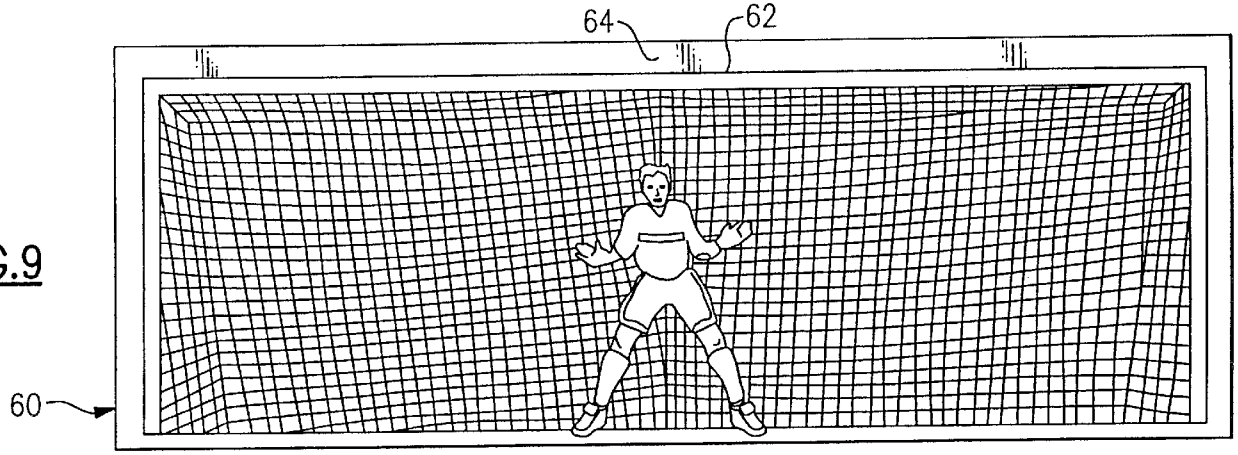
FIG. 9 is a front elevation of a soccer goal target according to an embodiment of this invention.
Figure 10:
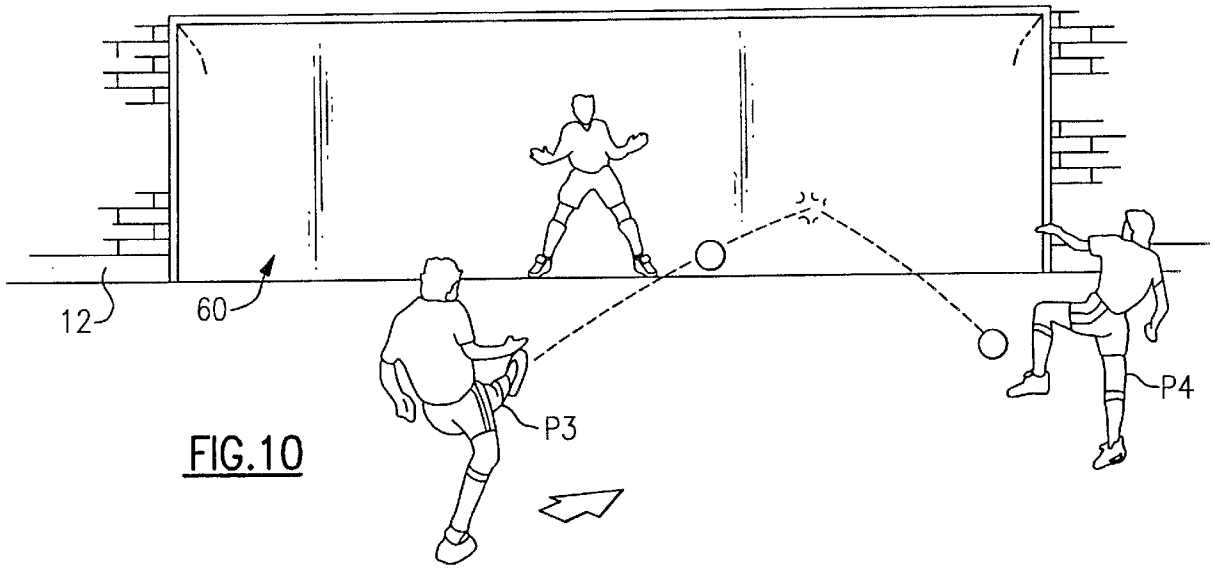
FIG. 10 is a perspective view illustrating a soccer practice or training drill employing the target of FIG. 9.

A soccer goal target 60 is illustrated in FIG. 9, in which a goal and goalie image 62 is imprinted on a panel 64. FIG. 10 illustrates this goal target 60 suspended on brick wall 12 and illustrates a soccer practice drill in which one soccer player P3 kicks the soccer ball into the goal net image 62 and another player P4 receives the rebound.

Figure 11:
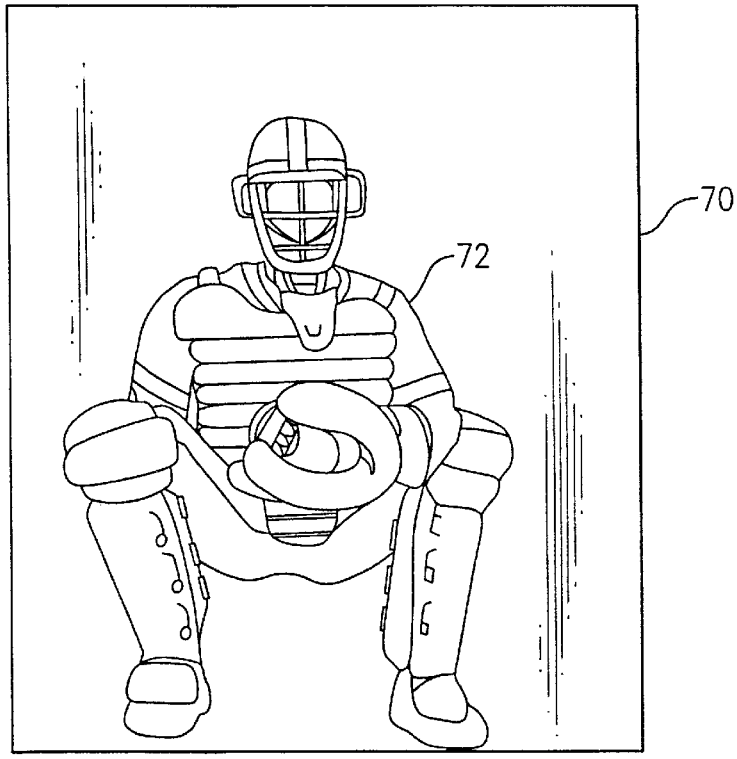
FIG. 11 is a front elevation of a baseball pitching target according to an embodiment of this invention.

A further goal target 70 for baseball pitching practice is shown in FIG. 11, in which an image of a baseball catcher 72 is imprinted on a panel 74. This can be mounted on the wall 12 in the manner described before, and for additional realism a portable home plate (not shown) can be place on the ground in front of the target 70.

The goal target of this invention may be configured with the image of another sport in addition to those shown here. Also, it is possible to provide other attaching means, although it is preferred that the portion that attaches to the wall 12 be non-damaging to the wall surface. The strips 18, 28, 40 can be located at the four corners, or along the top edge, or at other places on the target. Also, the target may be used indoors, or against a wood wall, or a wall made of some other material, if desired. The term "goal target" as used here is not limited to images of nets into which a projectile is thown to score, but should me taken to mean any image that represents some sporting situation in which a ball or similar projectile may be thrown or hit, or from which a ball may rebound towards a player.

While the invention has been described hereinabove with reference to a few preferred embodiments, it should be apparent that the invention is not limited to such embodiments. Rather, many variations would be apparent to persons of skill in the art without departing from the scope and spirit of this invention, as defined in the appended Claims.

I claim:

1. A goal target assembly for attaching to a vertical outside wall, comprising:

a fabric target formed of a flat, thin flexible material that is imprinted with a suitable target image to represent a sports goal;

a plurality of first strips of a hook-and-loop fastener material attached onto a back side of said fabric target; and a plurality of second strips of said hook-and-loop fastener material for releasably mating with said first strips, said second strips being backed with an adhesive adapted for attaching to a brick, stone, or concrete wall and which can be later removed from said wall without damage thereto, and wherein said target further includes one or more thin metal sheet portions disposed behind said flexible material at position or positions corresponding to portions of said image that represent a successful shot on goal, said metal sheet portions acting as sounders when hit by a ball.

2. A sports practice target assembly for attaching to a vertical outside wall, comprising:

a fabric target formed of a flat, thin flexible material that is imprinted with a suitable sports image to represent a sports target, wherein said flat thin material is adapted to transmit substantially all energy of a ball striking against it onto the supporting wall, so that the ball will rebound from the target;

a plurality of first strips of a hook-and-loop fastener material attached onto a back side of said fabric target;

a plurality of second strips of said hook-and-loop fastener material for releasably mating with said first strips, said second strips being backed with an adhesive adapted for attaching to a brick, stone, or concrete wall and which can be later removed from said wall without damage thereto; and a deadening material provided behind only a predetermined portion of said target.

3. A goal target assembly according to claim 2 wherein said plurality of second strips includes a supply of excess such strips so that the target can be relocated and repositioned, and so that the second strips can be replaced if they come loose from the wall.

* * * * *